US006287002B1

(12) United States Patent
Sherman et al.

(10) Patent No.: US 6,287,002 B1
(45) Date of Patent: Sep. 11, 2001

(54) DRAW CORD SYSTEM FOR OPENING AND CLOSING AN OPEN TOP OF A FABRIC CARRIER

(75) Inventors: Cynthia M. Sherman; William J. Gladden, both of Denver, CO (US)

(73) Assignee: Stone Creek, Inc., Denver, CO (US)

( * ) Notice: Subject to any disclaimer, the term of this patent is extended or adjusted under 35 U.S.C. 154(b) by 0 days.

(21) Appl. No.: 09/587,401

(22) Filed: Jun. 5, 2000

(51) Int. Cl.[7] ..... B65D 33/28

(52) U.S. Cl. ..... 383/74; 383/24; 383/72; 383/73

(58) Field of Search ..... 383/72–75, 6, 383/24, 35; 150/118; 224/235

(56) References Cited

U.S. PATENT DOCUMENTS

| | | | | |
|---|---|---|---|---|
| D. 143,227 | * | 12/1945 | Kaufman | 150/118 X |
| 366,942 | * | 7/1887 | Ernst | 383/35 X |
| 731,378 | * | 6/1903 | Luther | 150/118 |
| 1,310,869 | * | 7/1919 | McHugh . | |
| 2,040,271 | * | 5/1936 | Rosenzweig | 150/118 |
| 2,066,062 | * | 12/1936 | Quisling | 383/35 X |
| 2,084,757 | * | 6/1937 | Alter | 383/35 X |
| 2,227,390 | * | 12/1940 | Green | 383/35 X |
| 2,263,346 | * | 11/1941 | Arne | 383/73 |
| 2,428,227 | * | 9/1947 | Kase . | |
| 2,765,833 | * | 10/1956 | Kwon | 383/73 X |
| 3,428,103 | * | 2/1969 | Walsh | 383/24 |
| 3,599,690 | * | 8/1971 | Christie | 383/72 X |
| 3,965,953 | * | 6/1976 | Becker et al. | 383/6 |
| 4,739,880 | * | 4/1988 | Sawyer et al. | 383/72 X |
| 5,238,307 | * | 8/1993 | Mooney et al. | 383/74 |
| 5,609,419 | * | 3/1997 | Byers, Jr. | 383/35 X |
| 5,988,879 | * | 11/1999 | Bredderman et al. | 383/75 X |

FOREIGN PATENT DOCUMENTS

| | | | | |
|---|---|---|---|---|
| 91/01401 | * | 2/1991 | (WO) | 383/35 |

* cited by examiner

*Primary Examiner*—Allan N. Shoap
*Assistant Examiner*—Robin Hylton
(74) *Attorney, Agent, or Firm*—Edwin H. Crabtree; Ramon L. Pizarro; Donald W. Margolis

(57) ABSTRACT

A draw cord system for opening and closing and opening in a top portion of a fabric carrier. The opening and closing system includes the top carrier with the top portion and a bottom portion. The top portion includes the opening for receiving articles inside the carrier. Edges in the top portion and around the opening are folder over and stitched for forming a casing. The casing includes a first opening and a second opening. The two openings are disposed next to each other and are used for receiving a portion of an elongated draw cord inside the casing. The draw cord includes a first end portion and a second end portion extending outwardly from the openings. Part of the first and second end portions of the draw cord is received through a slide opening in an anchor housing. Ends of the first and second end portions of the draw cord are attached to a draw cord handle to form a draw cord tail. A portion of an anchor cord is wrapped around the anchor housing for holding the anchor housing is place. Ends of the anchor cord and a webbing loop strap are attached to a first side of the top portion of the carrier. A thumb ring strap is attached to a second side of the carrier. The webbing loop strap, the thumb ring strap and the draw cord tail are used for opening and closing the opening in the top portion of the carrier.

7 Claims, 1 Drawing Sheet

DRAW CORD SYSTEM FOR OPENING AND CLOSING AN OPEN TOP OF A FABRIC CARRIER

BACKGROUND OF THE INVENTION (a) Field of the Invention

This invention relates to opening and closing systems for different types of article carriers and more particularly, but not by way of limitation, to a draw cord system used for opening and closing an open top of a fabric carrier used for carrying various articles therein.

(b) Discussion of Prior Art

Heretofore, pull cords have been used for opening and closing different types of bags such as laundry bags, duffle bags and similar types of article carriers made of flexible fabric. Typically, a pull cord is received inside a hemmed casing and around the edges of an opening in the top of the article carrier. In closing the opening in the carrier, opposite ends of the cord are pulled with one hand in one direction moving a portion of the cord away from openings in the casing while the casing is gripped and moved in an opposite direction with the other hand. The casing is gathering together and the extended cord is tied in a knot next to the openings in the casing. This procedure holds the open top of the article carrier in a closed position. To open the open top, the knot in the cord is untied and the casing is ungathered around the extended portion of the cord, thereby opening the top of the article carrier for inserting various items therein.

In U.S. Pat. No. 1,310,869 to McHugh, a tobacco pouch is described having pouch with an open top and a pair of cross pieces attached to opposite sides of the open top. The ends of the cross pieces are attached to each other with one of the cross pieces longer than the other cross piece to form a bow thereon. By moving the bowed cross piece in opposite directions in relation to the shorter cross piece, the open top is held in an open position or a closed position.

In U.S. Pat. No. 2,428,227 to Kase, a bag made of flexible material is disclosed. The bag includes an open top with a pair of snap-frame beads secured around the edges of the open top. One of the beads overlaps a portion of the other bead in a snap fit for interlocking the two beads and holding the open top in a closed position.

The above mentioned open top carrier bags with pull cords and prior art patents do not describe or disclose the unique structure, function and advantages of the subject draw cord opening and closing system as described herein.

SUMMARY OF THE INVENTION

In view of the foregoing, it is a primary object of the subject invention to provide a unique draw cord system for opening and closing an opening in a top portion of a fabric carrier. The carrier may be a hand bag, purse, back pack, tote bag, duffle bag, laundry bag and the like for holding various articles therein.

Another object of the invention is the opening and closing system is designed to replace conventional closure devices such as zippers, book and loop fasteners and snaps which tend to wear out over a period of time or break and/or rust. The system can be operated with gloves or mittens and also can be opened and closed using only one hand.

Still another object of the system is the use of an anchor housing for holding a draw cord in place and holding the opening in the top portion of the carrier in a closed position, a partially open position and an open position.

Yet another object of the draw cord system is to provide a safe way of holding the open top of the carrier in a closed position. Whereby, a non-owner of the carrier, not familiar with the draw cord arrangement, will find it difficult to open for the unauthorized viewing and possible theft of the contents inside the carrier.

The opening and closing system includes an opening in a top portion of a fabric carrier for receiving articles inside the carrier. Edges in the top portion next to the opening are folder over and stitched for forming a casing. The casing includes a first opening and a second opening. The first opening and the second opening are disposed next to each other. The first and second openings are used for receiving a portion of an elongated draw cord inside the casing.

The draw cord includes a first end portion extending outwardly from the first opening in the casing and a second end portion extending outwardly from the second opening in the casing. Part of the first and second end portions of the draw cord is slidably received through a slide opening in a plastic anchor housing. Ends of the first and second end portions of the draw cord are attached to a draw cord handle. The ends of the first and second end portions of the draw cord and the draw cord handle form a draw cord tail. The draw cord tail is used for gripping and closing the open top.

A portion of an anchor cord is wrapped around the anchor housing for holding the anchor housing is place next to a first side of the top portion of the carrier. Ends of the anchor cord are attached to the first side of the carrier. A webbing loop strap is also attached to the first side of the carrier. A thumb ring strap, with thumb ring, is attached to a second side in the top portion of the carrier.

In operation, to close the opening in the top portion of the carrier, the owner of the carrier holds the webbing loop strap with one hand and with the other hand holds the draw cord tail. Also, the webbing loop strap can be held on a belt around an owner's waist or held firmly on a fixed object. As mentioned, the webbing loop strap is held in place or pulled in one direction, while the draw cord tail is pulled in an opposite direction. At this time, a portion of the draw cord is drawn from inside of the casing and pulled through the slide opening in the anchor housing with the casing gathered together around the remaining portion of the draw cord inside the casing.

To open the opening in the top portion of the carrier, the owner of the carrier holds the webbing loop strap with one hand and with the other hand grips the thumb ring. The webbing loop strap is held in place or pulled in one direction while the thumb ring is pulled in an opposite direction. At this time, the exposed portion of the draw cord is pulled through the slide opening in the anchor housing with the draw cord returning inside the casing as the casing is ungathered.

These and other objects of the present invention will become apparent to those familiar with the different types of closure systems for flexible bags with various types of openings when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
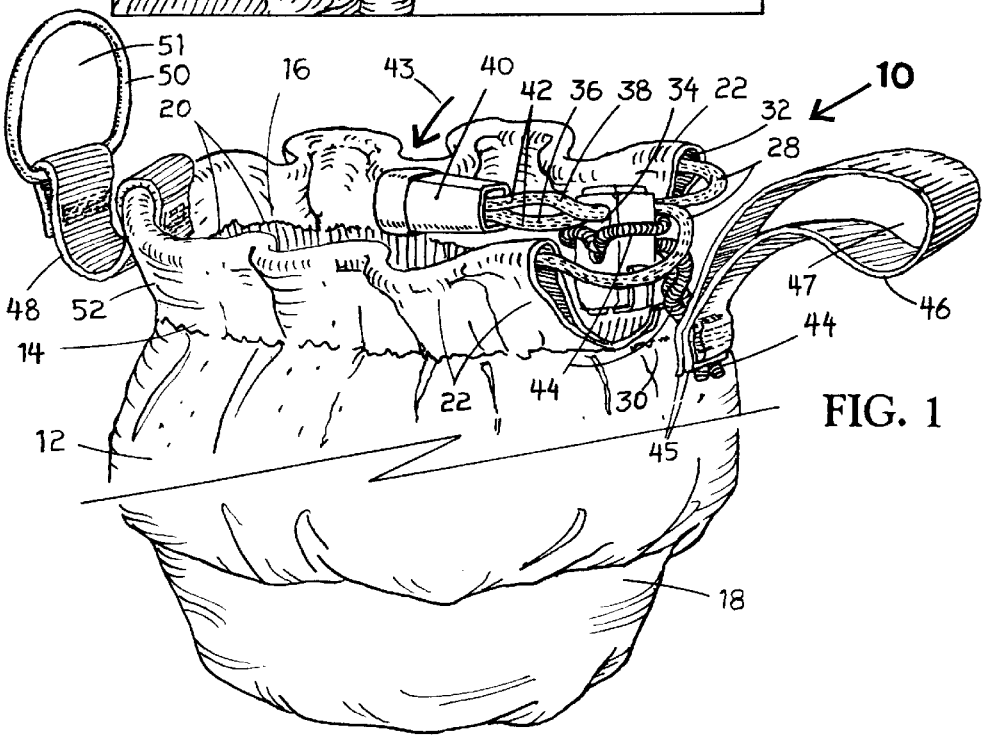
FIG. 1 is a perspective view of the draw cord opening and closing system mounted around and next to an opening in a top portion of a fabric carrier. A portion of a first side in the top portion of the carrier is cut away to expose an anchor housing and a draw cord tail in a lowered position resting in the top portion of the carrier.

In FIG. 1, a perspective view of the draw cord opening and closing system is illustrated having a general reference numeral 10. The system 10 includes a fabric carrier 12 having a top portion 14 with opening 16 therein and a closed bottom portion 18 for receiving various articles therein. As mentioned above, the carrier 12 may be of various sizes, shapes and made of different types of flexible fabric. The system 10 is designed to hold the opening 16 in a closed position, a partially open position and an open position.

Figure 2:
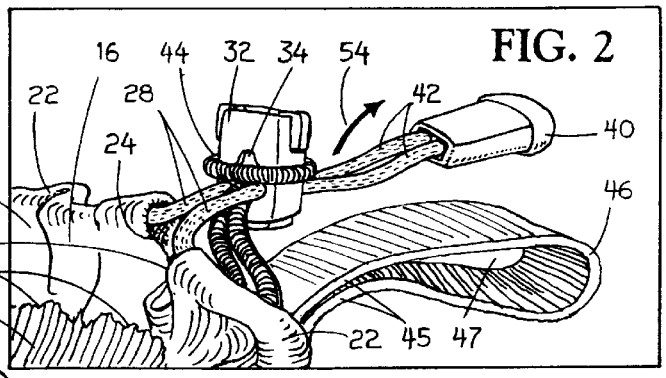
FIG. 2 is a perspective view of the first side portion of the top portion of the fabric carrier and illustrating end portions of the draw cord slidably received through a slide opening in the anchor housing with ends of the draw cord attached to a draw cord handle forming the draw cord tail.

Edges 20 around the opening 16 are folded over and stitched for forming a casing 22 therearound. The casing 22 includes a first opening 24 and a second opening 26. The two openings 24 and 26 are disposed next to each other and are shown in FIG. 2. The first and second openings 24 and 26 are used to receive a portion of a draw cord 28 inside the casing 22.

In FIG. 1, a portion of a first side 30 in the top portion 14 of the carrier 12 is cut away to expose an anchor housing 32 having a slide opening 34. A first end portion 36 and a second end portion 38 of the draw cord 28 are slidably received through the slide opening 34. Ends of the first and second end portions 36 and 38 of the draw cord 28 are attached to a draw cord handle 40. The ends of the first and second end portions 36 and 38 of the draw cord 28 and the draw cord handle 40 form a draw cord tail 42. The draw cord tail 42 is used for gripping and closing the opening 16 in the top portion 14.

In this drawing, the draw cord tail 42 and anchor housing 32 are shown in a folded out-of-the-way position, as indicated by arrow 43, next to the opening 16 in the carrier 12.

A portion of an anchor cord 44 is wrapped around the anchor housing 32 for holding the anchor housing 32 in place next to the first side 30 of the top portion 14 of the carrier 12. Ends of the anchor cord 44 are attached to the first side 30 of the carrier 12. Opposite ends 45 of a webbing loop strap 46 are also attached to the first side 30 of the carrier 12. The webbing loop strap 46 includes a hole 47 therethrough for inserting a finger or thumb therein and gripping the strap. A thumb ring strap 48, with a thumb ring 50, is attached to a second side 52 in the top portion 14 of the carrier 12. The second side 52 is opposite the first side 30 on the carrier 12. The thumb ring 50 includes a hole 51 therethrough for inserting a finger or thumb therein and gripping the ring. While the webbing loop strap 46 and the thumb ring 50 are shown in the drawings, a rope handle or similar gripping devices can work equally well when opening and closing the opening 16 in the fabric carrier 12.

In FIG. 2, a perspective view of the first side 30 of the top portion 14 of the fabric carrier 12 is illustrated. In this drawing, the first and second side portions 36 and 38 of the draw cord 28 are shown slidably received through the slide opening 34 in anchor housing 32. The anchor housing 32 and draw cord tail 42 are shown in a raised position, as indicated by arrow 54, above the top portion 14 of the carrier 12. It should be noted that the draw cord 28 rides against a portion of the anchor cord 44 inside the slide opening 34 and in a snug fit. Therefore, when the opening 16 is either open and particularly when in a closed position, the draw cord 28 and anchor housing 32 act together in holding the system 10 in place.

Figure 3:
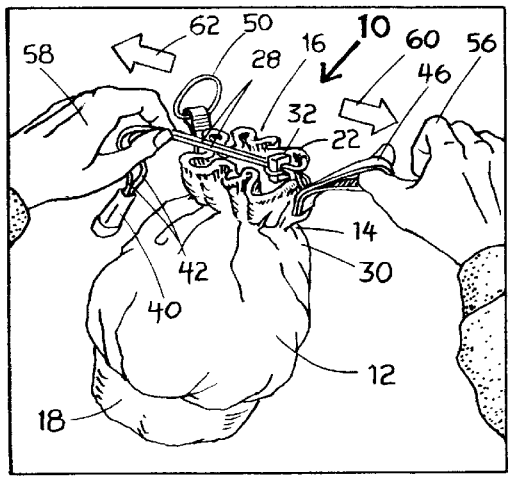
FIG. 3 is a perspective view of the draw cord opening and closing system with hands of the owner of the carrier used in closing the opening in the top portion of the carrier.

In FIG. 3, a perspective view of the draw cord system 10 is shown with the owner of the carrier 12 closing the opening 16 in the top portion 14 of the carrier 12. In this example, the owner of the carrier holds the webbing loop strap 46 with one hand 56. With another hand 58, the owner holds the draw cord tail 42 away from the webbing loop strap 46. The owner then pulls the webbing loop strap 46 in one direction, indicated by arrow 60 or the owner can merely hold the loop strap 46 in a fixed position. Also, the loop strap 46 could be attached to a belt around the owner's waist and held thereon. At the same time, the owner pulls the draw cord tail 42 in an opposite direction, indicated by arrow 62. At this time, a portion of the draw cord 28 is drawn from inside of the casing 22. Also, the draw cord 28 is pulled through the slide opening 34 in the anchor housing 32 with the casing 22 gathered together around the remaining portion of the draw cord inside the casing. The draw cord 28 is pulled until the casing 22 is completely gathered and the opening 16 is closed.

Figure 4:
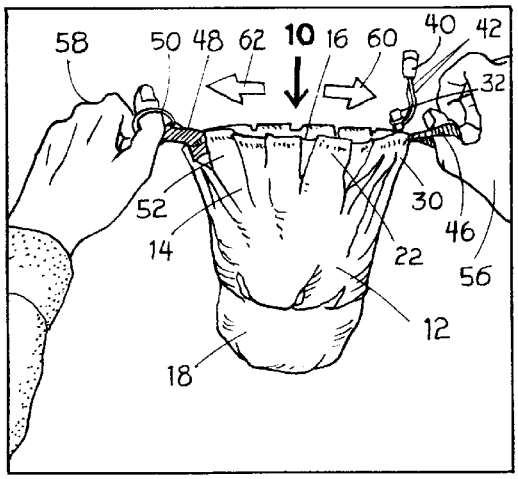
FIG. 4 is a perspective view of the draw cord opening and closing system with the hands of the owner of the carrier used in opening the top portion of the carrier.

In FIG. 4, a perspective view of the draw cord opening and closing system 10 is shown wherein the user of the carrier 12 is shown opening in the top portion of the carrier. To open the opening 16 in the top portion 14 of the carrier 12, the owner of the carrier holds the webbing loop strap 46 with the hand 56 and pulls in one direction, as indicated by arrow 60. Also, the webbing loop strap 46 can be held in place or can be held on a fixed object. With the other hand 58, the owner grips the thumb ring 50 pulling it in an opposite direction, as indicated by arrow 62. At this time, the exposed portion of the draw cord 28 is pulled through the slide opening 34 in the anchor housing 32 with the draw cord 28 returning inside the casing 22 as the casing is ungathered. When the opening 16 is in an open position as shown in this drawing, the casing 22 covers the majority of the draw cord 28 except a short portion of the draw cord 28 next to the anchor housing 32 and a portion of the draw cord making up the draw cord tail 42.

While the invention has been shown, described and illustrated in detail with reference to the preferred embodiments and modifications thereof, it should be understood by those skilled in the art that equivalent changes in form and detail may be made therein without departing from the true spirit, and scope of the invention as claimed, except as precluded-by the prior art.

What is claimed is:

1. A draw cord opening and closing system, the system comprising:

a fabric carrier having a top portion and a bottom portion, the top portion having an opening therein;

a casing formed in the top portion around edges next to the opening; said casing including a first opening and a second opening, the two openings are disposed next to each other;

a portion of an elongated draw cord received inside said casing, said draw cord having a first end portion extending outwardly from the first opening in said casing and a second end portion extending outwardly from the second opening in said casing;

an anchor housing having a slide opening therethrough, part of the first and second end portions of said draw cord received through said slide opening in said anchor housing;

an anchor cord, a portion of said anchor cord wrapped around said anchor housing for holding the anchor housing in place, ends of said anchor cord are attached to a first side of the top portion of said carrier;

a first gripping means attached to the first side of said carrier, said first gripping means for holding said carrier when opening and closing the opening in said carrier; and a second gripping means attached to a second side of said carrier, said second gripping means for holding said carrier when opening the opening in said carrier.

2. The system as described in claim 1 wherein ends of the first and second end portions of said draw cord are attached to a draw cord handle, the ends of said draw cord and said draw cord handle form a draw cord tail, said draw cord tail used for gripping when closing the opening in the top portion of the carrier.

3. The system as described in claim 1 wherein said first gripping means is a webbing loop strap, said webbing loop strap having opposite ends attached to the first side of said carrier.

4. The system as described in claim 1 wherein said second gripping means is a thumb ring with a thumb ring strap, an end of said thumb ring strap is attached to the second side of said carrier.

5. A draw cord opening and closing system, the system comprising:

a fabric carrier having a top portion and a bottom portion, the top portion having an opening therein;

a casing formed in the top portion around edges next to the opening; said casing including a first opening and a second opening, the two openings are disposed next to each other;

a portion of an elongated draw cord received inside said casing, said draw cord having a first end portion extending outwardly from the first opening in said casing and a second end portion extending outwardly from the second opening in said casing;

an anchor housing having a slide opening therethrough, part of the first and second end portions of said draw cord received through said slide opening in said anchor housing;

an anchor cord, a portion of said anchor cord wrapped around said anchor housing for holding the anchor housing in place, ends of said anchor cord are attached to a first side of the top portion of said carrier;

a webbing loop strap, said webbing loop strap having opposite ends attached to the first side of said carrier; and a thumb ring with a thumb ring strap, an end of said thumb ring strap attached to the second side of said carrier.

6. The system as described in claim 5 wherein ends of the first and second end portions of said draw cord are attached to a draw cord handle, the ends of said draw cord and said draw cord handle form a draw cord tail, whereby when said webbing strap is pulled in one direction or held in place and when said draw cord tail is pulled in an opposite direction, the opening in the top portion of said carrier is closed.

7. The system as described in claim 5 wherein said webbing loop strap has an opening therethrough, the loop strap hole adapted for receiving a finger or a thumb when opening and closing the opening in said carrier and said thumb ring having a thumb ring hole adapted for receiving a finger or a thumb when opening the opening in said carrier.

* * * * *